US006443082B1

(12) United States Patent
Lindström et al.

(10) Patent No.: US 6,443,082 B1
(45) Date of Patent: Sep. 3, 2002

(54) HALYARD DEVICE FOR SAILING BOATS

(75) Inventors: Mathias Lindström, Göteborg; Christer Bernson, Västra Frölunda, both of (SE)

(73) Assignee: Seldén Mast AB (SE)

( * ) Notice: Subject to any disclaimer, the term of this patent is extended or adjusted under 35 U.S.C. 154(b) by 0 days.

(21) Appl. No.: 09/609,479

(22) Filed: Jul. 5, 2000

(30) Foreign Application Priority Data

Jul. 6, 1999 (SE) ..... 9902611

(51) Int. Cl.[7] ..... B63H 9/04
(52) U.S. Cl. ..... 114/102.18; 114/108
(58) Field of Search ..... 24/115 G, 115 M, 24/115 R, 136 R; 114/102.1, 102.18, 104, 108, 111, 199, 218

(56) References Cited

U.S. PATENT DOCUMENTS 1,322,956 A * 11/1919 Ruff ..... 24/122.6
3,628,221 A * 12/1971 Pasbrig ..... 403/18
3,851,613 A * 12/1974 Armour ..... 114/230.23
3,996,873 A * 12/1976 Weghorn ..... 114/108
4,278,042 A * 7/1981 Lindquist ..... 114/218
4,425,862 A * 1/1984 Hirsch et al. ..... 114/199
4,465,011 A * 8/1984 Merry ..... 114/199
4,620,499 A * 11/1986 Slemmons ..... 114/218
4,873,934 A * 10/1989 Renault ..... 114/39.16

FOREIGN PATENT DOCUMENTS

DK 117466 A * 9/1984 ..... 114/199

* cited by examiner

*Primary Examiner*—S. Joseph Morano
*Assistant Examiner*—Andrew Wright
(74) *Attorney, Agent, or Firm*—Orum & Roth

(57) ABSTRACT

The invention relates to an arrangement for the detachable locking of a line (2) which is led out through an opening in, for example, a mast (55) on a sailing boat (6) in question and for enabling the line (2) to be led further to an existing winch on board. In accordance with the invention, a tension release device (1A) and a ferrule (1B) for the line (2) are formed by a common component. Each part of this common component (1) can be situated to either side (A and B respectively) of the wall (12) in the mast (5) and or a cockpit, through which a lead-in (11) for the line (2) extends.

6 Claims, 7 Drawing Sheets

HALYARD DEVICE FOR SAILING BOATS

BACKGROUND OF THE INVENTION

1. Field of the Invention

The present invention relates to an arrangement for the detachable locking of a line which extends through the wall of a mast or some other area which encloses a line on a sailing boat of the kind in question as far as the manoeuvring point for the line, and which comprises a tension release device with a locking component with a manually actuated operating device capable of actuation causing it to move against a holding component, and a ferrule for the line arranged next to a lead-in for the line.

Lines are normally led out from masts and through other walls, behind the spaces of which lines are enclosed in a movable fashion, via holes or slotted fittings, after which they continue through tension release devices which are securely screwed to the outside of the masts, for example, and finally to a winch. The task of the tension release device is thus to lock the end of the rope in question so that it can be removed from the winch, after which the winch can be used for another line. This avoids the need to have a winch for each line. The tension release devices are also so arranged that they permit winching-in of the line, including in the locked position, although in this case with greater friction than in the fully open position.

2. Description of the Related Art

Previously disclosed examples of such loaders are shown in U.S. Pat. No. 4,670,948A; U.S. Pat. No. 4,528,727A and U.S. Pat. No. 5,083,350A. All these previously disclosed tension release devices exhibit the primary disadvantage that they must be installed externally on masts or decks, which makes them bulky, and that sailors and sails and lines can become hooked fast, with the associated risk of damage, etc., being caused by the projecting handles and other component parts of the tension release device arranged in conjunction with them. In conjunction with this, the forces which act upon the tension release devices must be taken up only by the fixing screws that are screwed into the mast or the deck on the vessel in question, which can cause corrosion, eventually resulting in a weakened connection, and the fixing screws are subject to the risk of becoming corroded fast so that their removal is difficult.

This also means that a section of the line is present between the opening in the mast and the tension release device. This unprotected section is constantly exposed to sun, salt, weather and wind, which causes the line to be weakened in that particular section. The fact that this section is constantly under stress also exposes the line to being damaged more easily, for example if it is exposed to sharp objects on board. It also means that persons on board can be injured by it, for example as a result of becoming trapped.

SUMMARY OF THE INVENTION

The principal object of the present invention is thus, in the first instance, to solve the aforementioned problems in a safe and effective manner.

The aforementioned object is achieved by means of an arrangement in accordance with the present invention, which is characterized essentially in that the tension release device and the ferrule for the line are executed in the form of a common component.

The invention is described below as a preferred illustrative embodiment, in conjunction with which reference is made to the accompanying drawings, in which:

DETAILED DESCRIPTION

Figure 1:
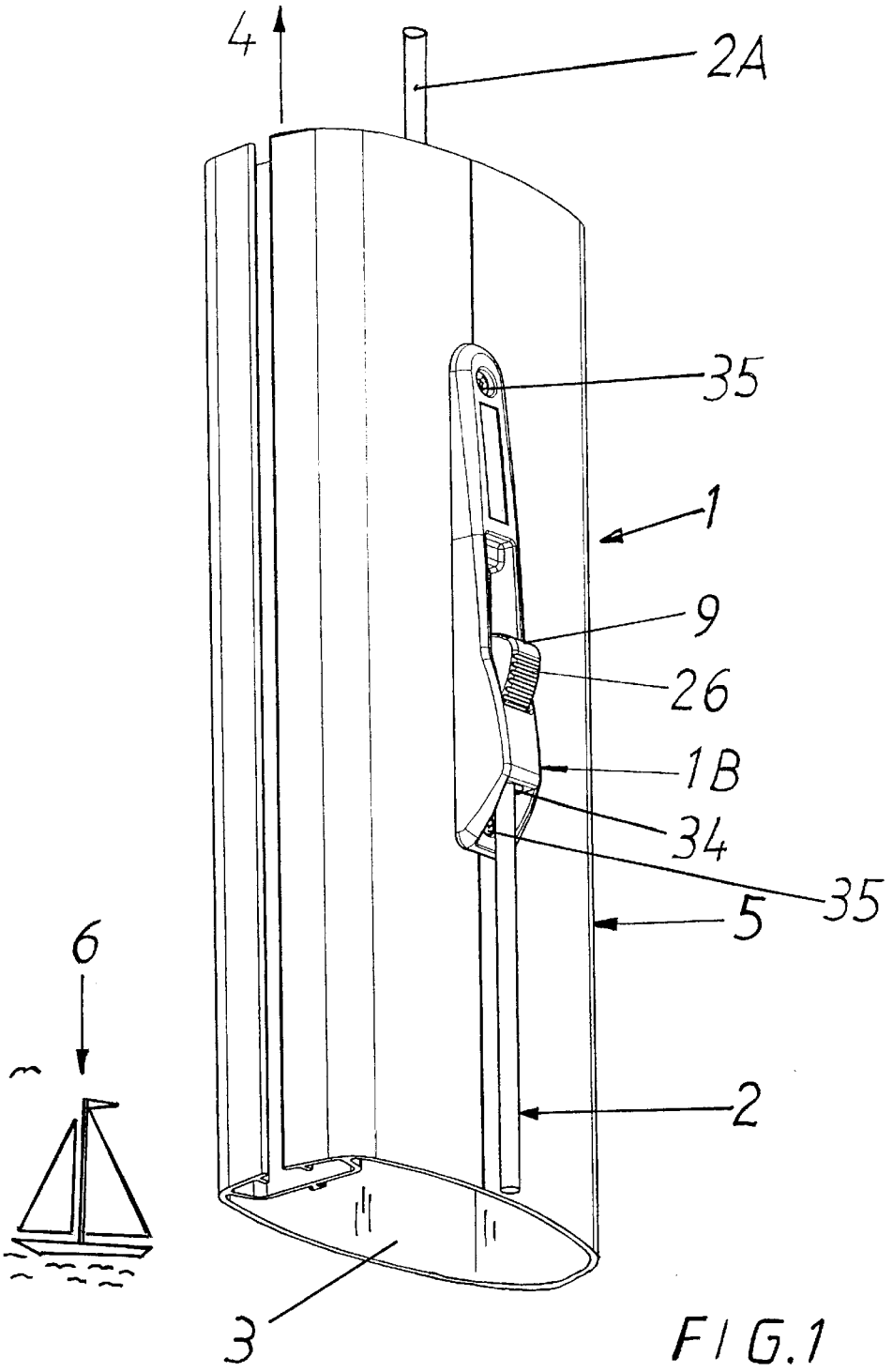
FIG. 1 shows a perspective view of a section of a mast from below and with an arrangement in accordance with the invention mounted thereon.
Figure 2:
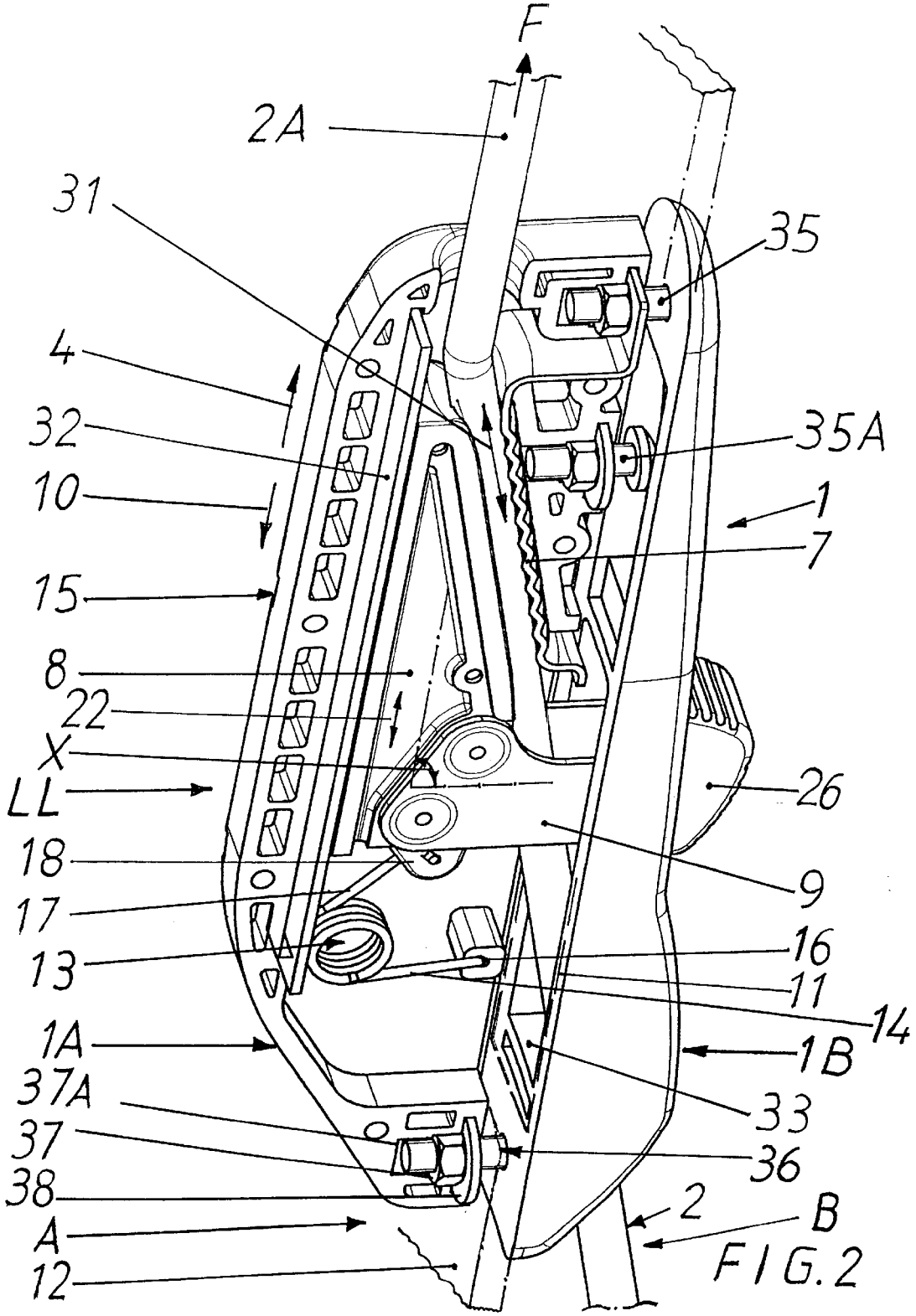
FIG. 2 shows the tension release device viewed in perspective as a partially sectioned view in which the end of a line is being clamped by it.
Figure 3:
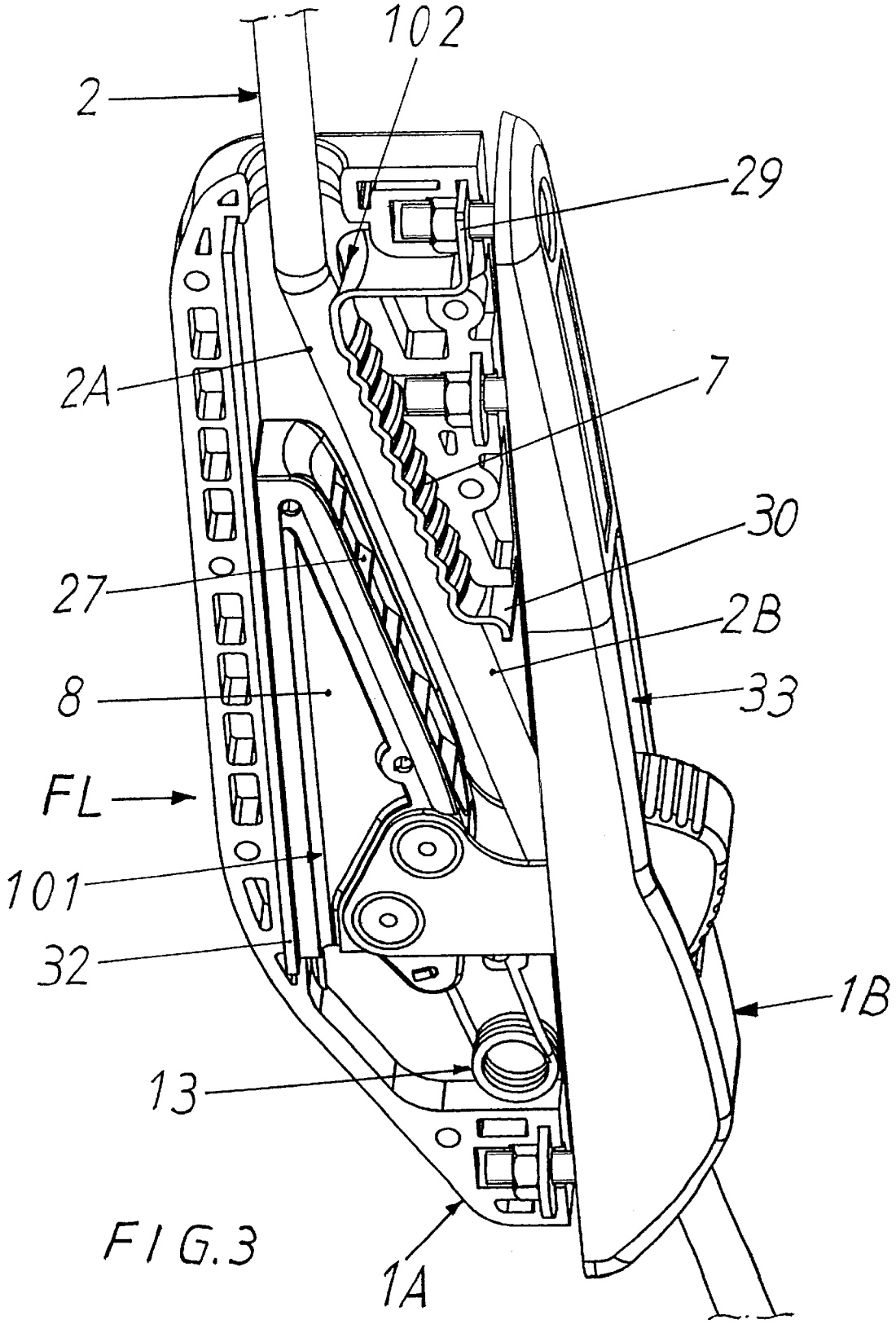
FIG. 3 shows the tension release device in an open released position in which the end of the rope runs freely therein.
Figure 4:
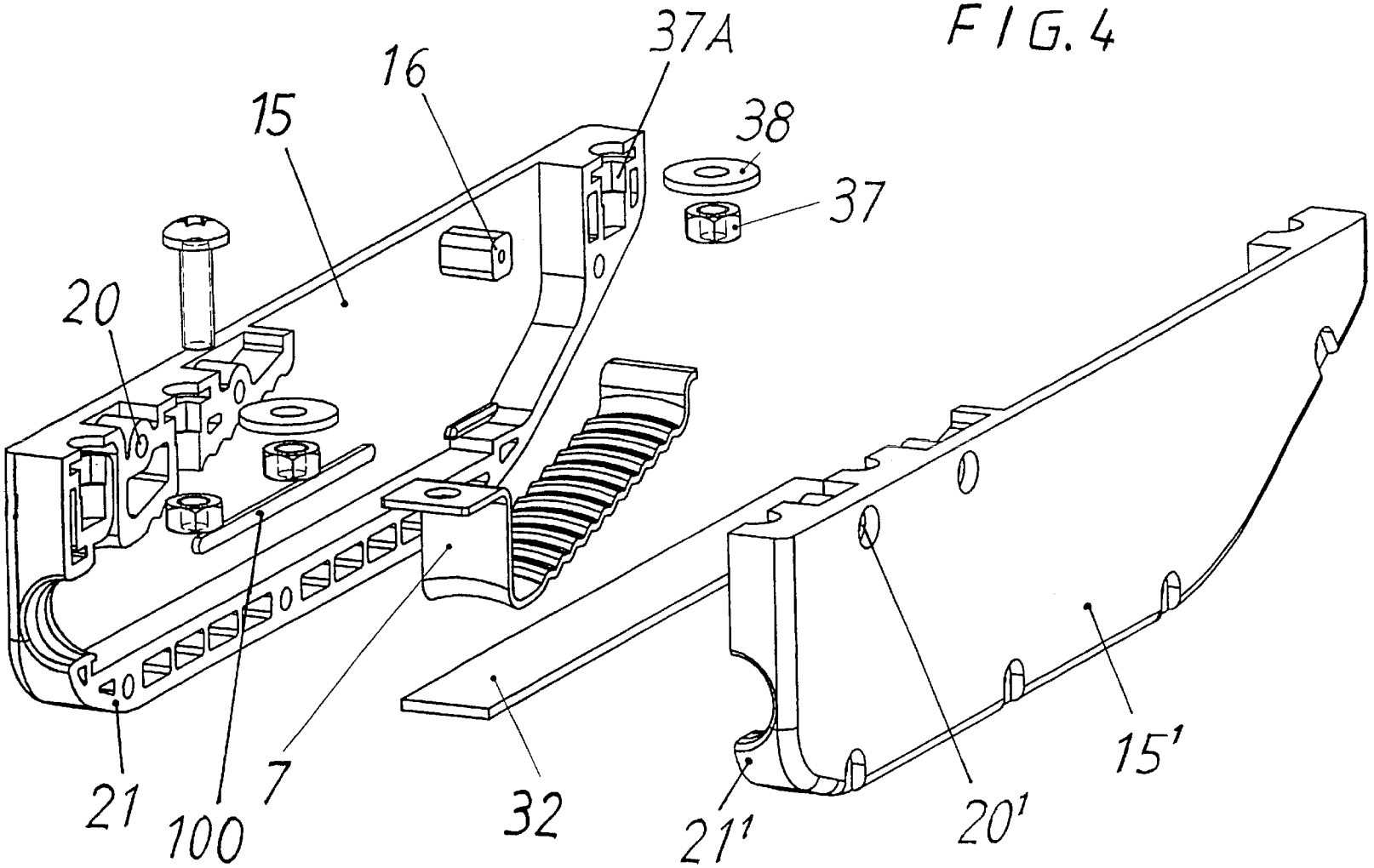
FIG. 4 shows an exploded view of the tension release device with certain component parts removed.
Figure 5:
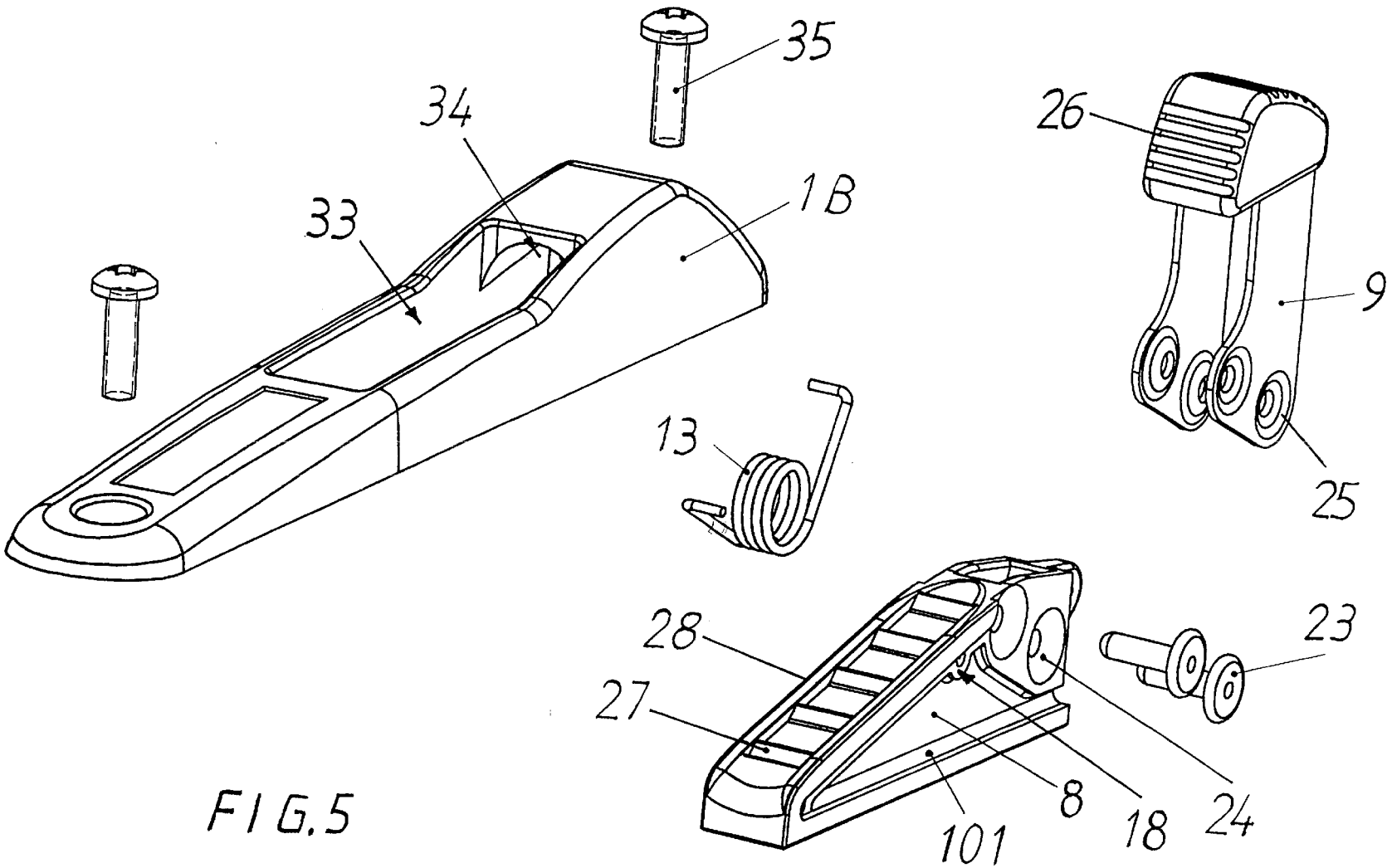
FIG. 5 shows an exploded view of the removed component parts.
Figure 6:
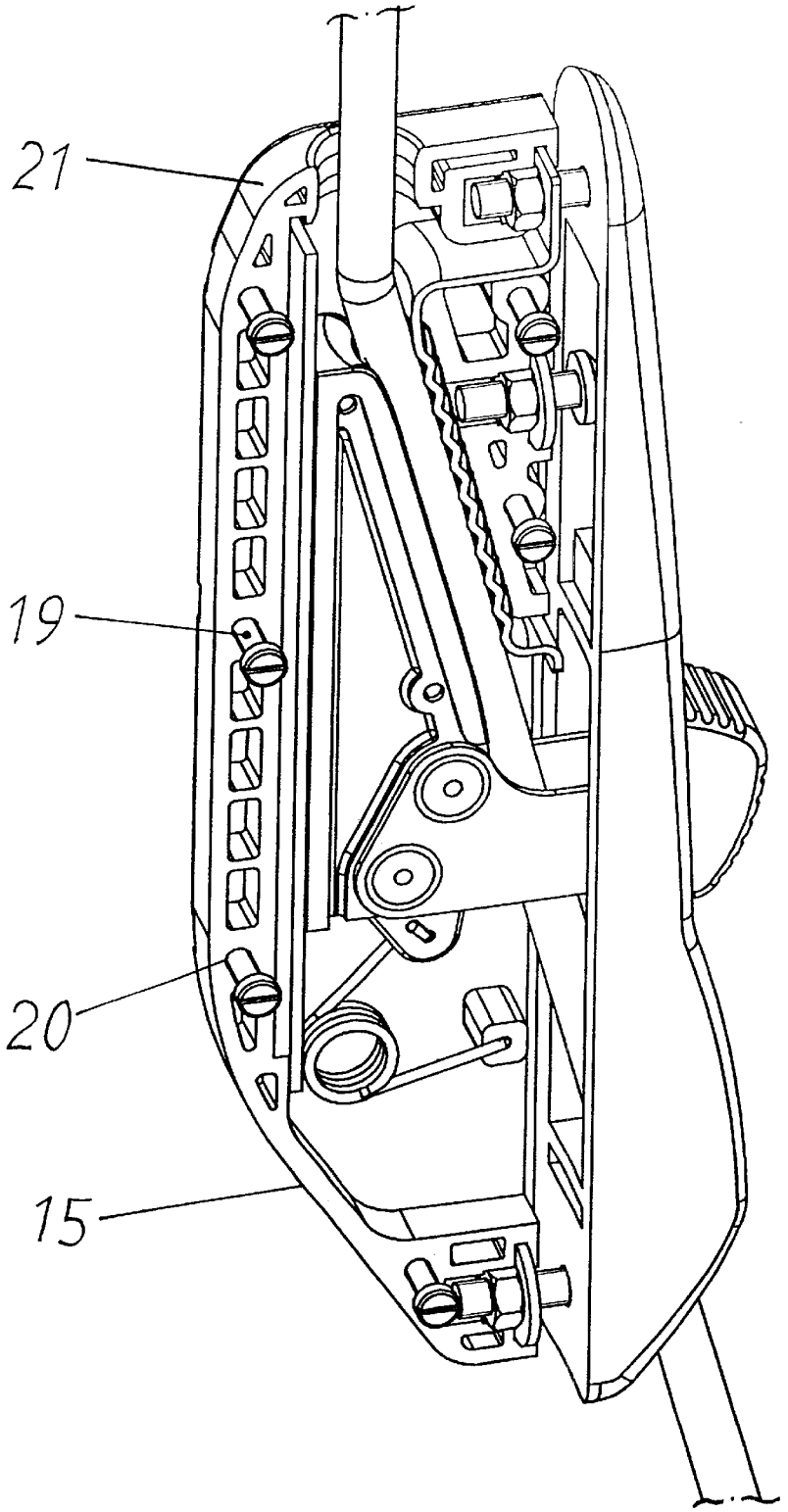
FIG. 6 shows a view of the arrangement in a partially sectioned view.
Figure 7:
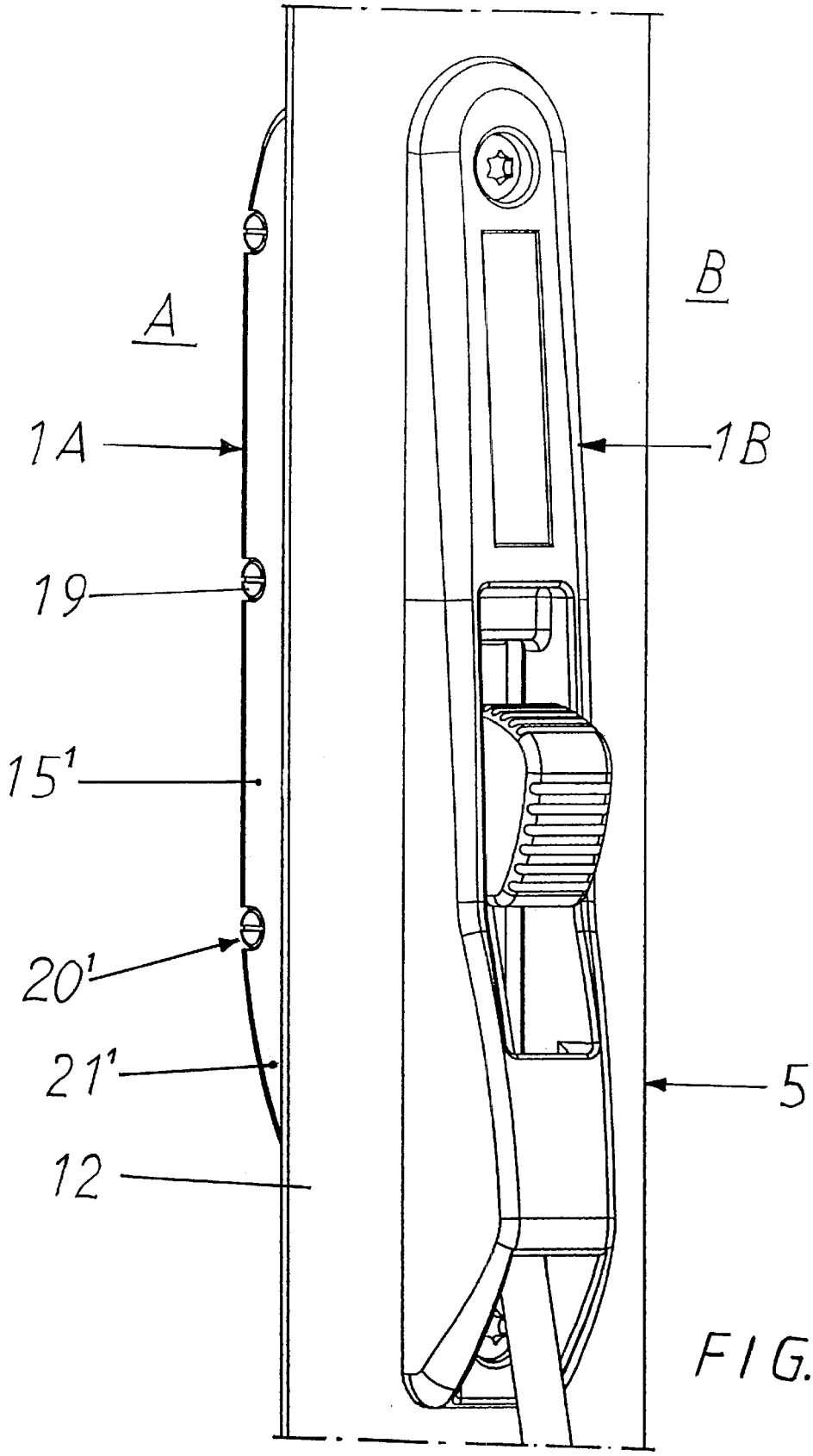
FIG. 7 shows the arrangement viewed from outside and also schematically inside a mast.

The invention is described below as an example of the mast on a sailing boat, in conjunction with which the invention is applied to a halyard which runs in the inside of the mast and out to the deck on the sailing boat, although the invention can naturally also be applied to lines other than halyards on board sailing boats. Lines in the example are designated by the specialist terminology halyard for this reason.

Furthermore, the space in which the line is enclosed is not restricted to masts alone, but other walls on board sailing boats through which it is wished to pass lines via openings are also possible, for example openings through decks to the cockpit, for example, or some other position on board.

An arrangement in accordance with the present invention is so arranged as to permit the detachable locking of halyards 2 which extend with one part 2A internally 3 up through a mast 5 on a sailing boat 6 of the kind in question or some other vessel to the manoeuvring point for the halyard 2, which arrangement comprises a tension release device 1A with a wedge capable of actuation causing it to be displaced towards a holding component 7. The aforementioned wedge 8 is capable of actuation causing it to be displaced by means of a manually actuated control device 9 respectively in an upward and downward direction 4 and 10. A ferrule 1B for the halyard 2 is arranged for this purpose next to a lead-in 11 in the wall 12 of the mast. A tension release device 1A and a ferrule 1B for the halyard 2 are formed by a common component 1 in this case. This common component 1 can either be undivided, in which case it is situated on the appropriate side of the wall through which the line passes, or it can be situated centrally between the sides in the opening. In the example illustrated and described here, the aforementioned component is divided into two parts, each of which parts 1A, 1B is situated on its own side A and B respectively of the wall 12 in the mast 5 and/or the cockpit (not shown), through which the lead-in 11 for the halyard 2 extends.

The arrangement 1 is, as mentioned above, intended essentially to be positioned on the mast 5, although it is also conceivable to position it at other points on the boat 6, for example alongside the routing of other lines to the cockpit, when the line can be led beneath the deck and then led up to a winch on the deck in a neat and space-saving fashion.

An element other than a wedge can also be arranged as a locking component 8, and mention can be made of, for example, a movably mounted cam, which, along one of its sides, can exhibit grip-increasing teeth, etc., although only a wedge 8 is indicated in the example.

The aforementioned wedge 8, which may consist of plastic, metal or some other suitable material or other elements which are capable of displacement with low friction against a counter-pressure surface, in conjunction with which consideration can also be given to rollers, wheels, and caterpillar tracks, is spring-assisted in such a way as to be moved between a locked position LL and a released position FL. The spring is preferably in the form of a spiral-wound torsion spring 13, which is connected with one spring leg 14 to a casing 15 and its internally hollow attachment 16, and is connected with its other spring leg 17 to a part 18 of the wedge 8, and preferably in such a way that a hole forms an attachment part for the spring 13. The aforementioned casing 15 can be assembled together with an essentially congruently executed casing part 15$^1$ by means of screws 19 or rivets which are accommodated in holes 20, 20$^1$ along their respective raised peripheral edges 21, 21$^1$, and is so arranged as to enclose the wedge 8 and the spring 13 and a number of other components included in the arrangement 1 in a protected fashion.

The control device 9, which consists of a lever preferably made of metal, extends outwards at an angle X from the wedge to the opposite side B of the wall 12 from the side A where the wedge 8 is accommodated in such a way as to be capable of displacement 22. The aforementioned lever 9 is fixed, for example by means of rivets 23, so that it is rigidly attached to the wedge 8 via holes 24, 25 passing through it. Present at the outermost end of the lever 9 is a preferably grooved gripping part 26 such as to enable a firm grip to be taken of it when actuating the lever 9 with the hand.

The aforementioned wedge 8 exhibits preferably a toothed line accommodating part 27, along which one side 2A of the line is so arranged as to make contact in order to obtain a firm grip along the inclined surface 28 of the wedge, and the aforementioned holding component 7, against which the opposite side 2B of the line is so arranged as to make contact in order also to obtain a firm grip, is in the form of a folded plate or, for example, a corrugated homogeneous piece of metal which is attached by its legs 29, 30 to the casing 15, 15$^1$ and is so arranged as to extend along the intended extent 31 of the halyard 2 internally inside the casing 15, 15$^1$.

The wedge 8 is also accommodated in such a way as to be capable of displacement along a track 32 functioning as a holding component surface, for example in the form of a guide rail, preferably made of metal.

The arrangement, which is a combined tension release device/slot fitting, leads out the line 2 from the mast 5 without causing wear to the line 2. The line 2 is locked by the toothed wedge 8, which presses the line 2 against the grooved holding component 7. The greater the loading imposed on the line 2, the harder the line 2 is securely wedged. The arrangement 1 is opened by first stretching the line 2 on a winch so that the wedge 8 is released, after which the wedge 8 is moved out manually to the fully open position with the help of the control device 9. A double-acting spring 13 holds the wedge 8 in the open position FL. In order to lock the arrangement, the wedge 8 is moved in towards the line 2 with a movement of the hand, in conjunction with which the double-acting spring 13 is caused to move over. In this position, the operating position, the wedge 8 is held in contact with the line 2 under the effect of the spring 13. The line 2 can run out, but it is locked in the direction of loading F, i.e. towards the top of the mast.

The aforementioned tension release device 1A and the ferrule 1B can be divided, in conjunction with which the casing 15, 15$^1$ is attached internally 3 inside the mast 5 and/or the cockpit (not shown), whereas the ferrule component 1B executed with a slotted lead-in 33 is attached to the outside of the aforementioned slotted hole 11 through the wall 12 of the mast 5 and/or in the wall of the cockpit.

The lever 9 is so arranged as to extend through the aforementioned hole 11 and opening 33. A downward-facing opening 34 extends from the aforementioned lead-in 33 for the control lever 9 to the outside of the lower part of the ferrule 1B to lead the halyard 2 between the inside 3 of the mast and the outside B of the mast 5. A ring, in which the line 2 runs, can thus be accommodated in the aforementioned opening 34.

Deflection of the line 2 internally in the mast 5 can be achieved with a deflection component 102 executed in such a way as to be gentle on the line 2, for example in the holding component 7 in its upper part, in order to deflect the line to the desired angle.

The arrangement 1 thus consists of a part 1A, which is placed inside the mast 5, and a part 1B, which is placed outside the mast. The inner part 1A is introduced in conjunction with installation through a slot 11 sawn into the mast 5 and is installed with screws 35 from the outside B through the external component 1B, and then through a clearance hole 36 in the wall 12 of the mast, and is finally secured in nuts 37 which are accommodated in cavities 37A in the actual fitting 1A and with retaining washers 38 behind. A fixing screw 35A is screwed in before the outside part 1B is placed on the mast 5.

The aforementioned tension release device 1A and the ferrule 1B exhibit an extended form and are capable of being screwed to one another as indicated above.

The tension release device 1A is divided along its longitudinal median plane, and the two parts 15, 15$^1$ of the casing are, as indicated above, capable of being screwed to one another across their longitudinal extent by means of screws 19 or are riveted together.

The function of the arrangement should have emerged from the above description and with reference to the illustrations in the drawings.

The novel features of the invention and the advantages associated therewith are summarized below.

Novel Features

The tension release device 1A/line ferrule 1B is partially recessed/positioned inside the mast 5.

In addition to locking the line 2, the tension release device 1A/line ferrule 1B also leads the line 2 out from the mast 5 in a manner that is gentle for the line 2.

There is no projecting handle with which lines and sails, etc., can become entangled—in either the open, locked or operating position.

The tension release device 1A/line ferrule 1B consists of two parts 1A, 1B, which, when assembled, form a clamped connection around the wall 12 of the mast.

Advantages

The function "lead out the line from the mast and down to the tension release device" occupies significantly less space than previously in a vertical sense on the mast, which space can be used for the attachment of other fittings. Also, the fact that no part of the line is exposed between the slot and the tension release device eliminates the risk of its being weakened by external influences.

Assembly with transcurrent screws, which clamp together the fitting instead of being threaded directly into the wall of the mast, prevents corrosion and in so doing provides a connection which avoids the risk of becoming weakened in time and is easy to dismantle even after a long period.

The position of the fitting inside the mast 5 now causes the outward-directed forces, which arise when the line is stretched with a winch, to be absorbed directly by the wall 12 of the mast without imposing any loading on the fixing screws.

The arrangement functions in the open position as a slotted fitting. If the tension release function is not required for any reason, there is thus no need to remove the tension release device 1A.

There is no projecting handle with which lines and sails, etc., can become entangled—in either the open, locked or operating position.

The low profile reduces the risk of impact and causing injuries.

The invention is not restricted to the illustrative example described above and shown in the drawings, but may be modified within the scope of the Patent Claims without departing from the idea of invention.

What is claimed is:

1. Arrangement for the detachable locking of a line which extends through a wall of a mast which encloses a line on a sailing boat and which comprises a tension release device with a wedge having a manually actuated operating device capable of actuation causing the wedge to move against a holding component and a ferrule for the line arranged next to a lead-in for the line, characterized in that:

the tension release device and the ferrule For the line are formed by a common component and the wedge is spring-assisted, arranged to be moved between a locked position and a released position; the tension release device and the ferrule is capable of being divided into two parts which are adapted to be detachably connected to one another, each of the tension release device and the ferrule is situated on an opposite side of the wall through which the lead-in for the line extends: a spiral-wound torsion spring is connected with one spring leg to a casing, which is arranged to enclose the wedge and the spring, and is connected with its other spring leg to a part of the wedge.

2. Arrangement in accordance with claim 1, characterized in that the aforementioned spring is double acting and holds the wedge in the released position and holds the wedge pressed against the line in the loaded position.

3. Arrangement in accordance with claim 1, characterized in that the operating device, which consists of a lever which extends outwards at an angle from the wedge to the opposite side of the wall wherein the wedge is arranged capable of displacement, is rigidly attached to the wedge.

4. Arrangement in accordance with claim 1 characterized in that the wedge is capable of displacement with low friction along a track in the casing functioning as a holding component surface.

5. Arrangement in accordance with claim 1, characterized in that a guide between the wedge and the casing is arranged to guide the wedge in the direction of displacement and to prevent the wedge from lifting from the track.

6. Arrangement in accordance with claim 1, characterized in that the holding component is in the form of one of a folded plate and a corrugated homogeneous piece of metal, attached to the casing and extends along an intended extent of the line.

* * * * *